United States Patent [19]

Jacobs

[11] Patent Number: 4,909,350

[45] Date of Patent: Mar. 20, 1990

[54] HOOK-ON SCAFFOLDING SUPPORT

[76] Inventor: John D. Jacobs, 4958 Lago Vista Way, Paradise, Calif. 95969

[21] Appl. No.: 408,804

[22] Filed: Sep. 18, 1989

[51] Int. Cl.[4] ..... E04G 3/08

[52] U.S. Cl. ..... 182/82; 248/235; 249/189

[58] Field of Search ..... 182/82, 229, 230, 222; 249/189; 248/235

[56] References Cited

U.S. PATENT DOCUMENTS

| | | |
|---|---|---|
| 71,960 | 12/1867 | Bliss . |
| 2,812,220 | 11/1957 | King . |
| 3,586,128 | 6/1971 | Sandberg . |
| 3,595,510 | 7/1971 | Hutchinson . |

*Primary Examiner*—Reinaldo P. Machado

[57] ABSTRACT

A generally triangular hook-on scaffolding support is formed by the alignment of a horizontal elongated top member over an angled brace and a vertical brace. A short section of serrated angle iron affixed transversely to one end of the top member abuts to inside surfaces of an opened stud wall and in conjunction with a wedge bracket and wedge board provides a strong pressure fitting for securing the scaffold in a stable position outside or by reverse attachment inside a building under construction. Another short angle iron section affixed to the distal end of the angled brace is adapted as a brace foot to engage the lengthwise edge of a horizontal board, either the bottom sole plate of the wall frame or a board nailed between studs, to provide base support for the scaffold. The scaffold can therefore be positioned at any height along the opened framed wall without the use of ground level support, nailing the hook-on scaffolding support to the framed wall, or assemblage of accessory parts.

5 Claims, 3 Drawing Sheets

HOOK-ON SCAFFOLDING SUPPORT

BACKGROUND OF THE INVENTION

1. Field of the Invention:

This invention relates to portable scaffolding of the type used in the construction trades, and more precisely to a scaffolding support structured to be releasably attached to studs in an open framed wall without the necessity of leveling according to ground conditions. The scaffolding support is used in units of two or more members to provide a scaffold supporting a walkway.

2. Description of the Prior Art:

Most existing scaffolds are either free-standing or lean-to sections constructed from the ground level upward, usually on the exterior of the building. To gain access to the upper sections of the building, the scaffold must be built-up in successive layers, taking considerable time, labor and materials. These types of devices generally require nailing of the scaffolding to the wall and or bracing of the ground level supports to secure the scaffold in a stable position. Nailing and ground bracing require additional time for the assembly and disassembly of the scaffolding which eventually increases job costs. A past art patent search indicated that a majority of patented scaffolds are of the free-standing or lean-to type. Typical of scaffolds disclosed in the search is one shown in a U.S. patent issued to Curtis B. Hutchinson for a "Convertible Scaffold." The U.S. Pat. No. is 3,595,510, and was issued on July 27, 1971. The Hutchinson device teaches an inverted L-shaped wall-supported scaffold brace which is attached to the top edge or window opening of a finished wall. Support for the Hutchinson structure is provided by an adjustable tension arm which fits over the top edge of the wall or window opening. The bottom abutment foot of the Hutchinson device is pivotal. Hutchinson's bracing, however, does not appear to provide sufficient lateral stability.

In a U.S. Pat. No. 3,586,128, issued to Sandberg on June 22, 1971, a lean-to, ground based scaffold support is shown. The device rests on a single leg and is supported laterally by a V structure attached or leaned against the side of a house.

Other examples of lean-to scaffolds are included in U.S. Pat. Nos. 2,812,220 and 71,960. The former issued in 1957 to H. King and the latter issued to Bliss in 1867. These and the foregoing seem typical of patented scaffolds in this field.

SUMMARY OF THE INVENTION

To overcome deficiencies seen in devices shown in past art patents and encountered on job sites, I provide a hook-on scaffolding support adapted to be secured to the opened frame of a stud wall maintained by pressure only. The hook-on scaffolding support is shaped generally triangular, structured of square tubular material, and comprises an elongated rectangular section as a horizontal platform support member positioned directly over and in alignment with an angled brace and a vertical brace. The vertical brace is positioned centrally between the platform support member and the angled brace attaching the two together with all three attached pieces forming a substantially right triangle structure. A first end of the horizontal platform support member extends beyond the connection of the vertical brace and is affixed with a short transverse horizontally positioned angle iron bar. The flat top section of the angle iron bar is serrated along an edge facing back at the platform support member and a second short angle iron bar, termed a wedge bracket, is horizontally attached transversely on top of the platform support member adjacent the serrated bar with the opened side facing towards the first terminal end of the horizontal platform support member. The positioning of the two short angle iron bars provides a locking device for the instant invention. The serrated edge of the end bar locks in behind the studs in an opened stud wall and a wedge board inserted between the top positioned angle iron wedge bar on the opposite side of the studs is pressed down locking the platform support member tightly to the opened stud wall. In cooperation with a third short piece of angle iron bar affixed transversely to an angle cut at the lower end of the angled brace which acts as a foot brace against the lower plate of the opened stud wall, this structure locks my entire scaffold member securely in position. Any two of my scaffold members so locked provides a firm and safe support for a scaffold platform.

As a further safety feature, at a second terminal end of my platform support member there is affixed a short vertically aligned safety rail attachment tube. The rail tube provides a holder for the insertion of an upright to which a safety rail can be attached running between two or more of my hook-on scaffolding supports along the edge of the walkway platform.

In use, each hook-up scaffolding support is positioned with the serrated edge of the transversely attached short angle iron bar at a first end of the horizontal platform support member abutting the inside edges of two studs of an unfinished frame wall. The horizontal platform support member extends between the two studs with a major portion outside the frame wall. The angled brace which runs downward from the second unattached end of the platform support member terminates resting of the foot brace rests on the outside edge of the bottom or sole plate of the open frame stud wall. In this position, a board, generally a two by four, is wedged in the angle iron wedge bar against the outside edges of both studs. A second hook-on scaffolding support according to the invention is aligned with the one so installed and attached in the same manner. Platform planks can then be laid on top of the aligned platform support members. Uprights for a safety rail can be inserted into the rail tubes and with horizontal safety rails installed along the outside edge of the platform planks, my scaffolding is secured and ready for safe use.

A horizontal board nailed along the outside of the stud wall or between two studs can be used to support the foot base allowing the scaffolding to be positioned at any height on the open frame wall. The horizontal board when nailed between two studs for use as the foot support base can be permanently left in place as it will generally not interfere with the rest of the building construction. Although my scaffolding is primarily designed for use on the outside of a building, during framing, the hook-on scaffolding supports could be reversed and used on the inside of the structure being framed.

Disconnecting the scaffolding is quick and easy. The bracing board inside the wedge bar against the studs is removed with a tap of a hammer. Each hook-on scaffolding support can then be lifted and turned so the serrated bar will pass through the studs and the scaffolding is free. The hook-on scaffolding supports are relatively lightweight, being structured of hollow square tubing, and can be easily carried and stored.

Therefore, it is a primary object of my invention to provide a wall supported hook-on scaffolding support which does not require ground level support.

A further object of my invention is to provide a hook-on scaffolding support which utilizes pressure fittings only to stabilize the scaffold laterally and vertically.

Another object of my invention is to provide a hook-on scaffolding support which can be easily repositioned vertically at any height along the framed wall without accessory supporting ground structures.

An even further object of my invention is to provide scaffolding which does not have an assemblage of parts requiring preassembly prior to use.

Other objects and advantages of my invention will be more fully described in the remaining specification with special referral made to the accompanying numbered drawings.

DESCRIPTION OF THE PREFERRED EMBODIMENT

Figure 2:
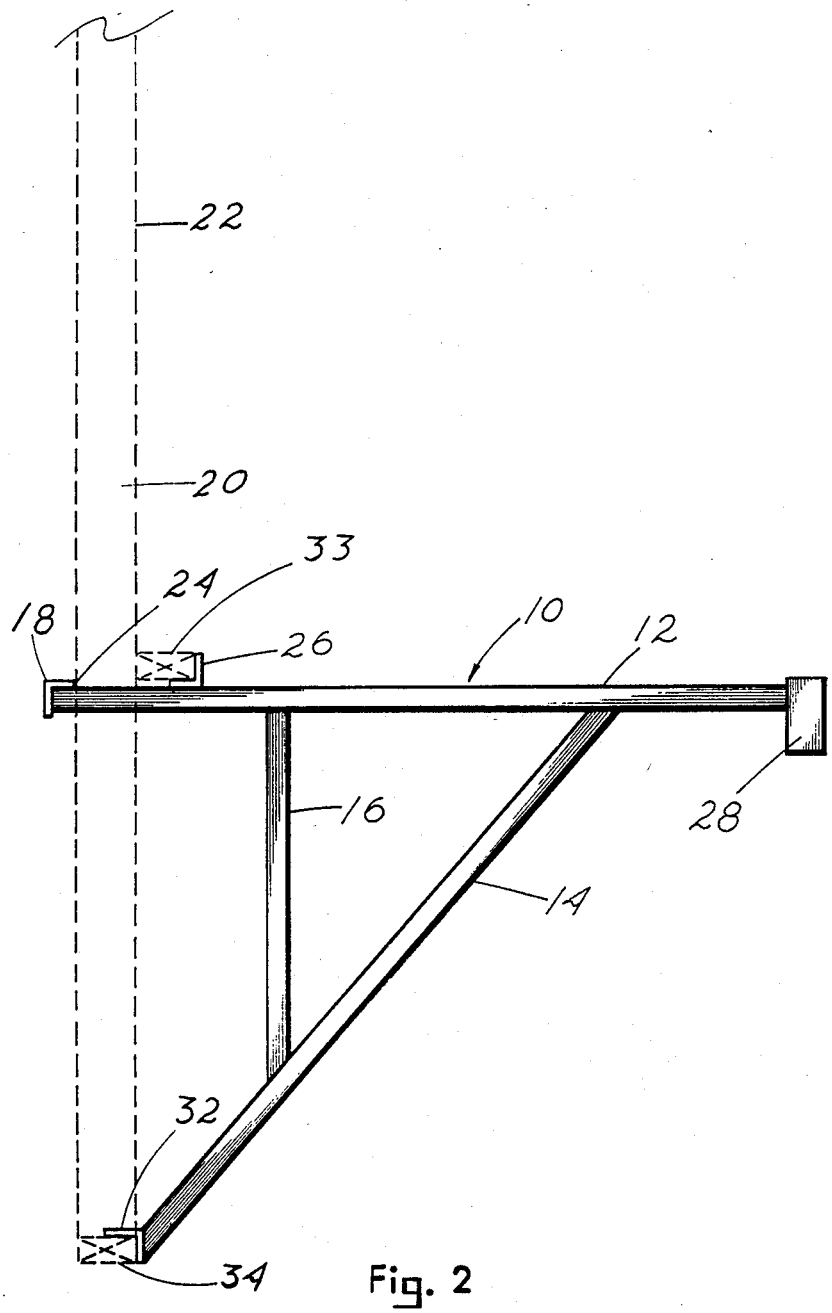
FIG. 2 is a side view of the hook-on scaffolding support of FIG. 1 affixed to a stud frame wall shown in dotted lines.

Referring now to the drawings where hook-on scaffolding support 10 is illustrated. Each hook-on scaffolding support 10 is comprised of elongated rectangular sections of metal tubing permanently joined by welding. Hook-on scaffolding support 10 is roughly structured triangular in shape, having one horizontal platform support member 12, an angled brace 14, and a vertical brace 16, shown in all Figures. Platform support member 12 has a first and second end, a top and bottom surface and two side walls. The first end of platform support member 12 is affixed transversely with a section of serrated angle iron 18. Serrated angle iron 18 is a right angled elongated section of metal sized in length to simultaneously abut the outside edges of two studs 20 of a framed wall 22. The length of serrated angle iron 18 must equal or exceed the distance between centers of two studs 20. This distance is usually from sixteen to twenty-four inches depending on local building codes and the design of the building. Serrated angle iron 18 has one lengthwise edge, referred to as serrated edge 24, facing the opposite or second end of platform support member 12. Serrated edge 24 is convoluted to provide a better gripping surface against studs 20. Adjacent and parallel to serrated angle iron 18 is a second shorter section of regular angle iron referred to as wedge bracket 26. Wedge bracket 26 is affixed to the top surface of platform support member 12 a specified distance from serrated edge 24, approximately the width of two studs 20. Normally studs 20 are approximately two by four inches or two by six inches in size. The second end of platform support member 12 is affixed with safety rail tube 28. Safety rail tube 28 is a short vertical section of rectangular metal tubing sized to retain one end of a board which is referred to as safety rail post 30. The interior diameter of safety rail tube 28 is slightly smaller in size than the exterior of safety rail post 30. This insures a snug fit when the bottom insertion end of safety rail post 30 is slightly tapered with the use of a knife or axe. Angled brace 14 depends downwardly from the bottom surface of platform support member 12 near the second end. Angled brace 14 angles downward and inward towards the first end of platform support member 12, and is endwardly affixed with foot brace 32. Foot brace 32 is comprised of a short section of angle iron of the same width as angled brace 14. Foot brace 32 is adapted to fit over an upper horizontal lengthwise edge of a board, usually the bottom or sole plate 34 of framed wall 22, best seen in FIG. 2 and 3. Vertical brace 16 depends downwardly from the bottom surface of platform support member 12 and terminates onto the top surface of angled brace 14, also best seen in FIG. 2. Vertical brace 16 helps to provide strength and rigidity to the framework of hook-on scaffolding support 10.

Figure 1:
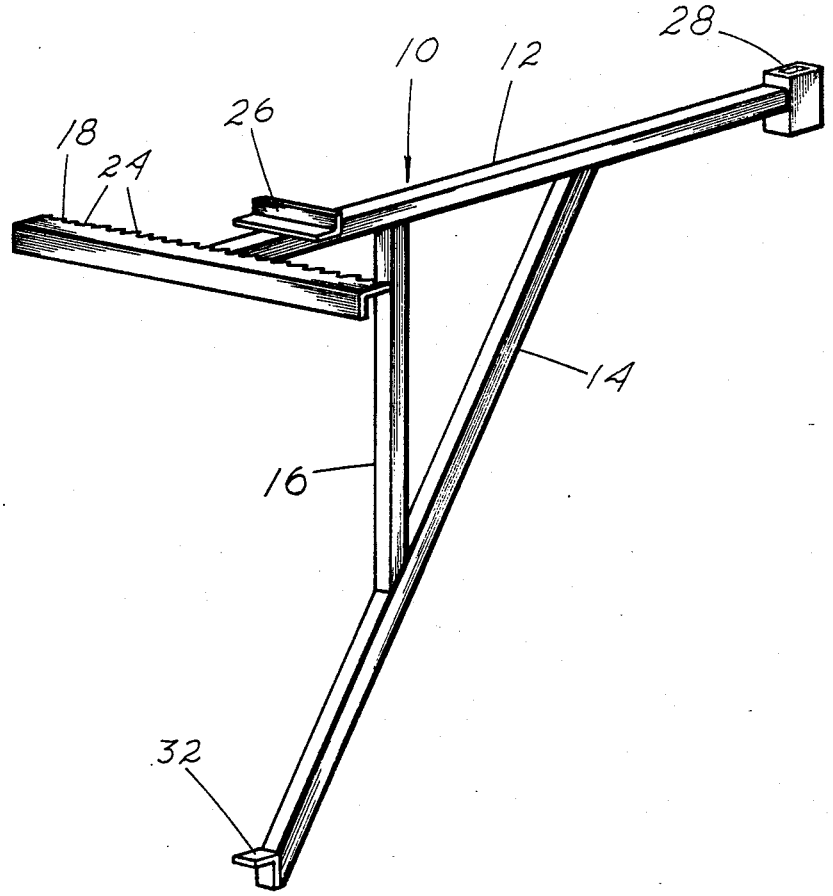
FIG. 1 is a perspective frontal view of a hook-on scaffolding support according to the invention showing component parts.
Figure 3:
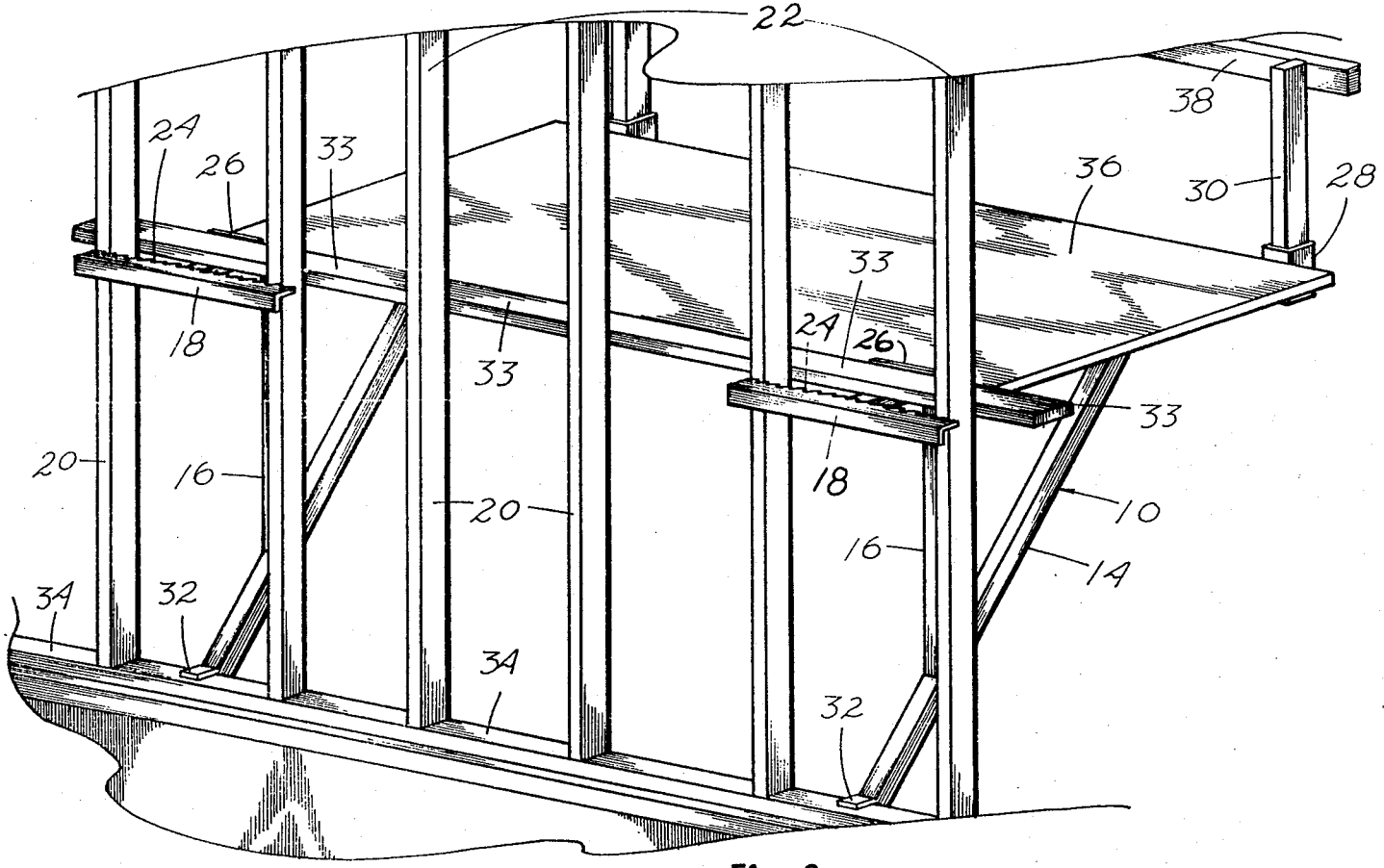
FIG. 3 is an in-use illustration of two hook-on scaffolding supports affixed to studs in the open frame wall of a building. The hook-on scaffolding supports are shown maintaining a plywood work platform with a single wedge board being utilized by both hook-on scaffolding supports simultaneously. A safety rail is illustrated attached at the back of the work platform.

In use, the second end of platform support member 12 is inserted between two studs 20 of framed wall 22 until serrated edge 24 abuts the edges of studs 20. Hook-on scaffolding support 10 can be positioned either on the inside of the building or outside. For clarification within this specification, framed wall 22, comprised most often of two-by-four eight-foot studs 20, is defined as a number of evenly spaced eight-foot sections of studs 20 connected on the top end by a horizontal top header rail and on the bottom by horizontal sole plate 34, with sole plate 34 affixed to the subfloor of the building. Framed wall 22 does not have exterior siding or interior sheetrock as yet affixed, thereby enabling the use of hook-on scaffolding support 10. With the majority of platform support member 12 projecting on the inside or outside of the building through framed wall 22, foot brace 32 is positioned on the top edge of sole plate 34, as shown in FIG. 1 and 3. A board, referred to as wedge board 33, is then forced between wedge bracket 26 and the side edges of both studs 20 which are abutting serrated edge 24. Wedged board 33 must be long enough to at least abut both edges of studs 20, but can also be long enough to be utilized by the second hook-on scaffolding support 10, which is positioned adjacent and parallel to the first, as shown in FIG. 3. The distance between both scaffolds 10 is determined by the strength and type of material to be used as walkway platform 36. Walkway platform 36 can be a section of plywood, as shown in FIG. 3, or a number of planks laid side by side with the ends supported by the top surface of platform support member 12. Although not essential for the performance of hook-on scaffolding support 10, for safety reasons the lengthwise edges of walkway platform 36 should abut wedge bracket 26 with the opposite lengthwise edge abutting safety rail tube 28. Safety railing 38 can be added to the free edge of walkway platform 36 with the use of safety rail tube 28 and safety rail post 30, as shown in FIG. 3.

My invention of hook-on scaffolding support 10 includes many advantages over the existing similar types of devices. Each unit of the pair of scaffolds 10 required to support walkway platform 36 is lightweight and easy to carry. Each hook-on scaffolding support 10 can be easily set-up and disassembled without help. This device has no moving or pivoting parts or any accessory sections connected with nails, bolts or other similar connective means which could become lost or misplaced. By serrated angle iron 18 abutting two studs 20 with subsequent bracing of the same studs 20 by wedge bracket 26, hook-on scaffolding support 10 is secured from lateral or pivotal movement. Hook-on scaffolding support 10 can also be positioned at almost any height along framed wall 22 with the addition of a horizontal support board nailed between two studs 20 as a support for foot brace 32. As construction sites generally have an abundance of variable lengths of discarded studs 20, the boards used to brace against wedge bracket 26, for safety rail post 30 and safety railing 38, are readily available and there is usually no need to supply these boards or accessory sections with hook-on scaffolding support 10.

Although I have described and detailed my invention in the previous specification, it is to be understood that all illustrations and descriptions are illustrative of the idea of the invention only. Various adaptations of the design of my device can be made without effecting the functioning of the present invention, and I therefore reserve the right to modify hook-on scaffolding support insofar as such modifications remain within the scope of the appended claims.

What I claim as my invention:

1. A hook-on scaffolding support adapted for releasable attachment to open framework of a building, said scaffolding support having a horizontal top member with said top member elongated between a first end and a second end and aligned in a vertical plain with and above an angled brace attached under said top member adjacent said second end thereof and radiating downward therefrom and a vertical brace attached substantially centrally between said top member and said angled brace with said attachments producing triangular rigidity in said hook-on scaffolding support; said top member affixed transversely at said first end by a short angle-iron shaped first bar having one edge thereof serrated with said serrated edged affixed facing towards said top member and being adapted for levering against opposing surfaces of said open framework, said top member affixed on an upper side to one surface of a short second bar, said second bar angle-iron shaped and transversely attached to said top member with an open side facing said serrated edge of said first bar a measured distance therefrom in an arrangement providing a wedging bracket for insertion of wedging material to reinforce said releasable attachment of said scaffolding support to said open frame of said building, there being a short third bar, said short third bar angle-iron shaped and transversely affixed to a distal end of said angled brace with an open side faced away from said angle brace and adapted for resting against horizontal members of said open frame of said building; means adapting said scaffolding support for attachment of a safety rail thereto.

2. The hook-on scaffolding support of claim 1 having said top member further adapted for supporting a substantially level walkway platform cooperatively with an alignment of one or more duplicates of said hook-on scaffolding support according to the invention.

3. The hook-on scaffolding support of claim 1 wherein said means adapting said scaffolding support for attachment of a safety rail thereto includes a short piece of vertically aligned rectangular tubing affixed to said second end of said top member.

4. The hook-on scaffolding support of claim 1 wherein said arrangement providing a wedging bracket for insertion of wedging material to reinforce said releasable attachment of said scaffolding support to said open frame of said building includes said serrated edge of said first bar abutted against first vertical surfaces of said framework with said framework being for example a stud wall and said second bar closely adjacent opposite second vertical surfaces of said example stud wall with space for insertion of a wedging block between said second bar and said stud wall.

5. The hook-on scaffolding support of claim 1 wherein said scaffolding support is manufactured of light weight square tubing with the preferred material being metal.

* * * * *